US009284697B2

(12) United States Patent
Steffen

(10) Patent No.: US 9,284,697 B2
(45) Date of Patent: Mar. 15, 2016

(54) GROUND-COMPACTING DEVICE

(75) Inventor: Michael Steffen, Munich (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 69 days.

(21) Appl. No.: 13/989,617

(22) PCT Filed: May 14, 2012

(86) PCT No.: PCT/EP2012/002066

§ 371 (c)(1),
(2), (4) Date: May 24, 2013

(87) PCT Pub. No.: WO2012/171604

PCT Pub. Date: Dec. 20, 2012

(65) Prior Publication Data

US 2013/0251452 A1 Sep. 26, 2013

(30) Foreign Application Priority Data

Jun. 15, 2011 (DE) ..... 10 2011 104 269

(51) Int. Cl.

| | |
|---|---|
| ***E01C 19/35*** | (2006.01) |
| ***E01C 19/38*** | (2006.01) |
| ***E02D 3/074*** | (2006.01) |
| ***E01C 19/30*** | (2006.01) |

(52) U.S. Cl.

CPC ..... *E01C 19/30* (2013.01); *E01C 19/35* (2013.01); *E01C 19/38* (2013.01); *E02D 3/074* (2013.01)

(58) Field of Classification Search

CPC ..... E01C 19/34; E01C 19/30; E01C 19/35; E01C 19/38; E02D 3/068; E02D 3/074

USPC ..... 404/133.05, 133.1, 133.2

See application file for complete search history.

(56) References Cited

U.S. PATENT DOCUMENTS

| | | | | |
|---|---|---|---|---|
| 6,139,217 | A | 10/2000 | Reuter | |
| 6,460,006 | B1 | 10/2002 | Corcoran | |
| 6,582,155 | B1 * | 6/2003 | Bromberger et al. | 404/133.05 |
| 6,619,125 | B2 | 9/2003 | Laugwitz | |
| 6,923,595 | B1 | 8/2005 | Chek | |
| 6,953,304 | B2 | 10/2005 | Quenzi et al. | |
| 6,973,821 | B2 | 12/2005 | Corcoran | |
| 6,976,805 | B2 | 12/2005 | Quenzi et al. | |
| 7,121,762 | B2 | 10/2006 | Quenzi et al. | |
| 7,320,558 | B2 | 1/2008 | Quenzi et al. | |

(Continued)

FOREIGN PATENT DOCUMENTS

| | | | |
|---|---|---|---|
| DE | 3702832 | A1 | 8/1988 |
| DE | 299 20 177 | U1 | 1/2000 |

(Continued)

*Primary Examiner* — Abigail A Risic

(74) *Attorney, Agent, or Firm* — Boyle Fredrickson, S.C.

(57) ABSTRACT

A working device for ground compaction comprises an upper mass, a guide device coupled to the upper mass and intended to guide the working device, a lower mass which can move relative to the upper mass, which is movably coupled to the upper mass via a spring device, and which has a ground contact plate, and a vibration-generating device for producing a relative movement between the upper mass and the lower mass. Furthermore, a drive for driving the vibrating-generating device is provided, wherein the drive comprises an electric motor. The electric motor is supplied with electrical energy via an electrical energy store arranged on the guide device.

16 Claims, 2 Drawing Sheets

(56) References Cited

U.S. PATENT DOCUMENTS

| | | | | |
|---|---|---|---|---|
| 7,491,011 | B2 | 2/2009 | Quenzi et al. | |
| 7,682,102 | B1 | 3/2010 | Burke et al. | |
| 7,873,492 | B2 | 1/2011 | Ackermann | |
| 7,909,533 | B2 | 3/2011 | Quenzi et al. | |
| 2008/0247824 | A1 | 10/2008 | Steffen | |
| 2011/0091279 | A1* | 4/2011 | Kuerten | 404/133.1 |
| 2013/0004237 | A1 | 1/2013 | Krings et al. | |
| 2013/0251452 | A1 | 9/2013 | Steffen | |
| 2013/0279980 | A1 | 10/2013 | Steffen | |

FOREIGN PATENT DOCUMENTS

| | | | |
|---|---|---|---|
| DE | 10 2007 006 209 | A1 | 2/2007 |
| DE | 20 2010 009 261 | U1 | 6/2010 |
| DE | 10 2009 004 442 | A1 | 7/2010 |
| EP | 1 196 309 | B1 | 7/1999 |
| EP | 1 267 001 | A1 | 6/2001 |

* cited by examiner

GROUND-COMPACTING DEVICE

BACKGROUND OF THE INVENTION

1. Field of the Invention

The invention relates to an implement for compacting the ground according to patent claim 1, for example a vibration plate or a tamper.

2. Discussion of the Related Art

In construction zones, implements for compacting the ground are typically driven by internal combustion engines in order to be able to provide a high level of power from the implement regardless of a current source in a power supply system or regardless of a generator. This results in noise and exhaust gases which can impair the health of the construction personnel and can harm the environment. By way of example, when such machines are used in trenches, the exhaust emission can quickly reach the pollutant concentration which is critical for a user. Another drawback of using an internal combustion engine is the need to fill the appliance with fuel and additives such as lubricants and coolants and also the need to service the internal combustion engine.

To counteract these drawbacks, it is known practice to drive such implements with electric motors, which can be supplied with electric power from a shore socket and/or from a generator, for example. A drawback of this is the dependency on the availability of such a current source.

With the increasing availability of electrical energy stores or storage batteries in a suitable power class, it is becoming conceivable for implements for compacting the ground also to be powered from such energy stores. For this, it should be borne in mind that suitable installation space is required on the appliance and that the generally heavy storage battery can adversely influence the weight of the appliance. A further drawback is that such energy stores can become damaged as a result of the harsh environmental conditions in the direct surroundings of the implement and as a result of the mechanical loading. This results in high costs, hinders operation on construction sites and presents a risk to construction personnel in the event of a possible explosion in a faulty energy store.

SUMMARY OF THE INVENTION

The invention is based on the object of specifying an implement for compacting the ground which allows extensive freedom from emissions and independence from external current sources while simultaneously providing ease of operation by the user.

This object is achieved by an implement for compacting the ground that has an upper mass and a guide apparatus or guide, coupled to the upper mass, for guiding the implement. In addition, the implement has a lower mass which can move relative to the upper mass, is coupled to the upper mass via a spring device and has a ground contact plate. In addition, an oscillation excitation apparatus for producing relative motion between the upper mass and the lower mass is provided. For the purpose of driving the oscillation excitation apparatus, a drive with an electric motor is provided. The electric motor can be supplied with electric power by an electrical energy store or storage unit arranged on the guide apparatus.

The implement for compacting the ground may be a vibration plate or a ground compactor, such as a tamper.

The guide apparatus allows a user to guide the implement over the ground to be compacted, for example soil. By way of example, it may have a guide pole, a guide frame or a guide bow for pulling or pushing the implement over the ground to be compacted or for holding and controlling the implement. To this end, the guide apparatus may be provided with a guide grip or handle for a user, on which there may also be arranged operating elements for operation, for example actuation and interruption of the implement.

The lower mass may be coupled to the upper mass, for example by a spring device which serves as an oscillation decoupling or damping device, so as to be able to move resiliently. The upper and lower masses can be set in oscillation relative to one another by the oscillation excitation apparatus or compaction device. In the case of a vibration plate, the oscillation excitation apparatus may be arranged on the lower mass, and in the case of a tamper, it may be arranged on the upper mass or between the upper mass and the lower mass. To produce the oscillations, the oscillation excitation apparatus or compaction device in the case of a vibration plate may have at least one unbalanced shaft having an unbalanced mass arranged thereon. In the case of a tamper, the oscillation excitation apparatus or compaction device has a crank assembly, for example.

In addition, the lower mass may have a ground contact plate arranged and, by way of example, rigidly mounted on it which can be set into a tamping and/or vibrating working motion by the oscillations in the lower mass. During operation of the implement, the ground contact plate can hit the ground to be compacted in a vibrating fashion and can compact it.

The oscillation excitation apparatus, for example the unbalanced shaft or the crank assembly, may be able to be driven by the drive, for example the electric motor. By way of example, the drive may be arranged on the upper mass or the lower mass.

The electric motor may be able to be powered solely or exclusively by the electrical energy store, for example. Alternatively, the electric motor can also be supplied with electric power either by the energy store or by means of connection to an external current source, for example using a socket on a power supply system, a site current source or a generator.

The electrical energy store may be any energy store for storing and outputting electric power. It may have an electrical rechargeable battery, for example with electrochemical cells (storage battery cells). It is possible to use a lithium ion storage battery (Li ion type), but also to use further types of storage batteries. In addition, the energy store may also be compiled from a plurality of storage batteries.

The energy store may have a housing which holds the storage batteries and/or storage battery cells and which may have an electrical coupling device for coupling the storage battery cells to the electric motor or to a charger, for example. In addition, the housing may have operator control elements, such as a charge state indicator and/or an operating temperature indicator. Alternatively, the energy store may also be designed without an additional housing in order to require as little installation space as possible, for example, when it is fitted into the implement.

The arrangement of the energy store on the guide apparatus allows the user to access the energy store easily. By way of example, this facilitates the operation of operator control elements on the energy store, e.g. for checking the charge state indicator or the operating temperature indicator. In addition, the arrangement allows the energy store to be easily connected to a charger or allows the energy store to be easily hooked up to an external current source, since the guide apparatus and hence also the energy store are easily accessible to the user. In addition, the storage battery arranged on the guide apparatus increases the mass of the guide apparatus relative to the upper mass and the lower mass, in particular, which entails an improvement in the smooth operation of the implement on the guide apparatus.

In one embodiment, the guide apparatus can move relative to the upper mass, and an oscillation decoupling device is arranged between the upper mass and the guide apparatus. The oscillation decoupling device may be in the form of a damping device and may have elastic buffers, such as rubber buffers and/or a spring device.

The oscillation decoupling device allows the guide apparatus and the storage device supported thereon to be decoupled from vibrations in the implement which arise as a result of the oscillations in the lower mass, are transferred to the upper mass, which is coupled to the lower mass, and act on the guide apparatus that is coupled to the upper mass. The mechanical stress caused by the vibration, which can damage both the user and the energy store, is significantly reduced by the oscillation decoupling device of the guide apparatus. The hand-arm vibrations on the guide grip can be significantly lowered thereby, and the energy store is protected against the mechanical loading. This effect is further enhanced by the mass of the energy store, which increases the relative mass of the guide apparatus in comparison with the upper and lower masses.

In a further embodiment, the guide apparatus has a hollow body in which the energy store can be arranged. By way of example, the hollow body may have a part with a cavity, said part being lengthwise. By way of example, the hollow body of the guide apparatus may be in the form of a pipe, particularly in the form of a steel pipe, in which the energy store may be inset or able to be inset. The pipe may be arranged as a design element of the guide apparatus and may form a longitudinal or transverse strut for a guide frame or for a pulling or pushing apparatus, for example. In particular, the pipe can be used as part of a guide pole and can allow the user to have forces exerted on the implement in order to guide the implement during operation.

As a result of the energy store being held in the hollow body, the energy store may be arranged on the implement without this requiring further, for example separate, installation space.

In addition, the hollow body may be terminated such that it protects the energy store against soiling during harsh construction operation.

A suitable rigidity in the hollow body, for example in the steel pipe, allows the energy store to be protected against external mechanical influences which arise during construction operation and can damage the energy store. In addition, the hollow body can also protect the user against thermal and/or mechanical effects of a possible explosion in a faulty energy store, for example. The inclusion of the energy store in the hollow body allows the thermal and mechanical effects of such an explosion to be contained or at least moderated.

As a result of the energy store being inset in the hollow body, it is possible, insofar as the hollow body has suitable thermal conductivity and there is suitable thermal coupling between the energy store and the hollow body, for the hollow body to dissipate the reaction heat from the energy store during charging and/or discharging to the ambient air. In other words, the hollow body can increase the surface of the energy store that exchanges heat with the surroundings, and can act as a heat sink. By way of example, this can be achieved by virtue of the hollow body being in the form of a steel pipe which has a large surface and into which the energy store can be directly inset and thereby brought into direct contact with the pipe. The large surface of the steel pipe allows effective dissipation of the reaction heat.

In a further embodiment, the guide apparatus may have a cooling device for cooling the energy store. By way of example, a thermally conductive contact apparatus may be provided which connects the surface of the storage battery to the surface of the guide apparatus or of the hollow body or steel pipe. The surface of the guide apparatus may be provided with cooling ribs or other deformations that enlarge the surface, in order to enlarge the area of contact with the ambient air. In addition or alternatively, ventilation slots may be provided which allow the heated air to escape, for example from a storage battery housing of the guide apparatus. In addition, an air conveying device can intensify the ventilation through the ventilation slots. The air conveying device may be operated by a conveyor wheel, e.g. a fan, which is operated by the energy store, or else may be operated by a bellows element which is mechanically coupled to the lower mass or upper mass oscillating relative to the guide apparatus.

In a further variant, the guide apparatus may have, in an area surrounding the energy store, a pressure equalization element for channeling off a pressure after a pressure rise caused by the energy store. In the event of an explosion, for example in a faulty energy store, the pressure equalization element can channel off the resultant pressure deliberately from the guide apparatus to a safe location that is remote from the user. By way of example, the pressure equalization element may be arranged on a side of the guide apparatus which is averted from the guide grip. As a result, the user can be kept away from and protected against thermal and/or mechanical effects of the explosion.

By way of example, the pressure equalization element may have a predetermined breaking point on the guide apparatus. This predetermined breaking point may be designed such that it withstands the mechanical loadings which occur during normal operation of the implement but breaks in the event of the energy store exploding. Thus, the hollow body which has the energy store inset in it can rupture at the predetermined breaking point in the event of such an explosion. Alternatively, or in addition, the pressure equalization element may also have a valve for deliberately channeling off pressure and/or heat away from the user.

In a further embodiment, the guide apparatus may have a holder or bracket for reversibly inserting the energy store. By way of example, the guide apparatus may have a housing having an opening for introducing and/or removing the energy store. The housing may have an electrical contact apparatus, by means of which the energy store can be brought into electrical contact with the implement, particularly the electric motor. The reversible, that is to say undoable, insertion or connection of the energy store on the guide apparatus allows the energy store to be easily replaced or serviced. By way of example, an empty energy store can be removed and introduced into a suitable charger, while a charged energy store is pushed into the implement. This allows the use of an external charger and hence a simple design for the implement.

In one variant, the guide apparatus and the energy store may have a further oscillation decoupling device arranged between them. By way of example, this further oscillation decoupling device may have one or more elastic buffers and/or spring devices which decouple the holder or the housing for holding the energy store from the oscillations which are present on the guide apparatus. In addition, the energy store can be held resiliently in the holder or on the guide apparatus. The additional oscillation decoupling allows the usually sensitive and expensive energy store to be additionally protected against mechanical stress.

In a further embodiment, the drive may also have an internal combustion engine in addition to the electric motor. The oscillation excitation apparatus can be operated either by the internal combustion engine or by the electric motor. Such a hybrid drive allows the implement to be operated using the electric motor, which is powered from the energy store, for example, when there is poor ventilation, for example, e.g. in the area of trenches, while the oscillation excitation apparatus can be driven by the internal combustion engine when there is good ventilation and/or when the energy store is empty. This allows uninterrupted use of the implement in a manner matched to ambient conditions with simultaneously great independence from current sources, chargers and/or fuel reserves.

In a further variant of this embodiment, the energy store may be able to be charged by means of a generator which is operated by the internal combustion engine. Thus, the electric motor may be able to be operated as an electric motor and/or a generator depending on the application and the needs of the application, for example. While the implement is being operated by the internal combustion engine, it is thus additionally possible to charge the energy store. In addition, the internal combustion engine can be operated while the implement is at rest, and can charge the energy store via the generator. Since it is not absolutely necessary for the implement to be controlled by the user during this time, the user can keep away from the implement and is not adversely affected by the exhaust emission. This allows great independence from external current sources and chargers. The physical integration of the generator and the electric motor makes it possible to save on production costs, installation space and weight.

In a further embodiment, an electronic control apparatus coupled to the energy store, the drive and/or the oscillation excitation apparatus may be provided on the guide apparatus. Said electronic control apparatus can be supplied with electric power by the energy store. It can control the charging and discharging processes of the energy store, the operation of the drive and/or the operation of the oscillation excitation unit, for example in line with a user specification on an operator control element of the implement. The arrangement of the control apparatus on the guide apparatus further increases the relative weight of the guide apparatus in relation to the upper mass and the lower mass, which further improves the smooth operation of the implement. The hand-arm vibration on the guide apparatus is lowered further. In addition, the control apparatus can be coupled directly to the energy store, which reduces the susceptibility to error in the coupling. Furthermore, in this arrangement the generally sensitive electronics of the control apparatus on the guide apparatus, which is decoupled from the upper mass by the oscillation decoupling device, are protected against the mechanical vibrations of the implement.

These and further features of the invention are explained in more detail below using examples with reference to the accompanying figures.

DETAILED DESCRIPTION

Figure 1:
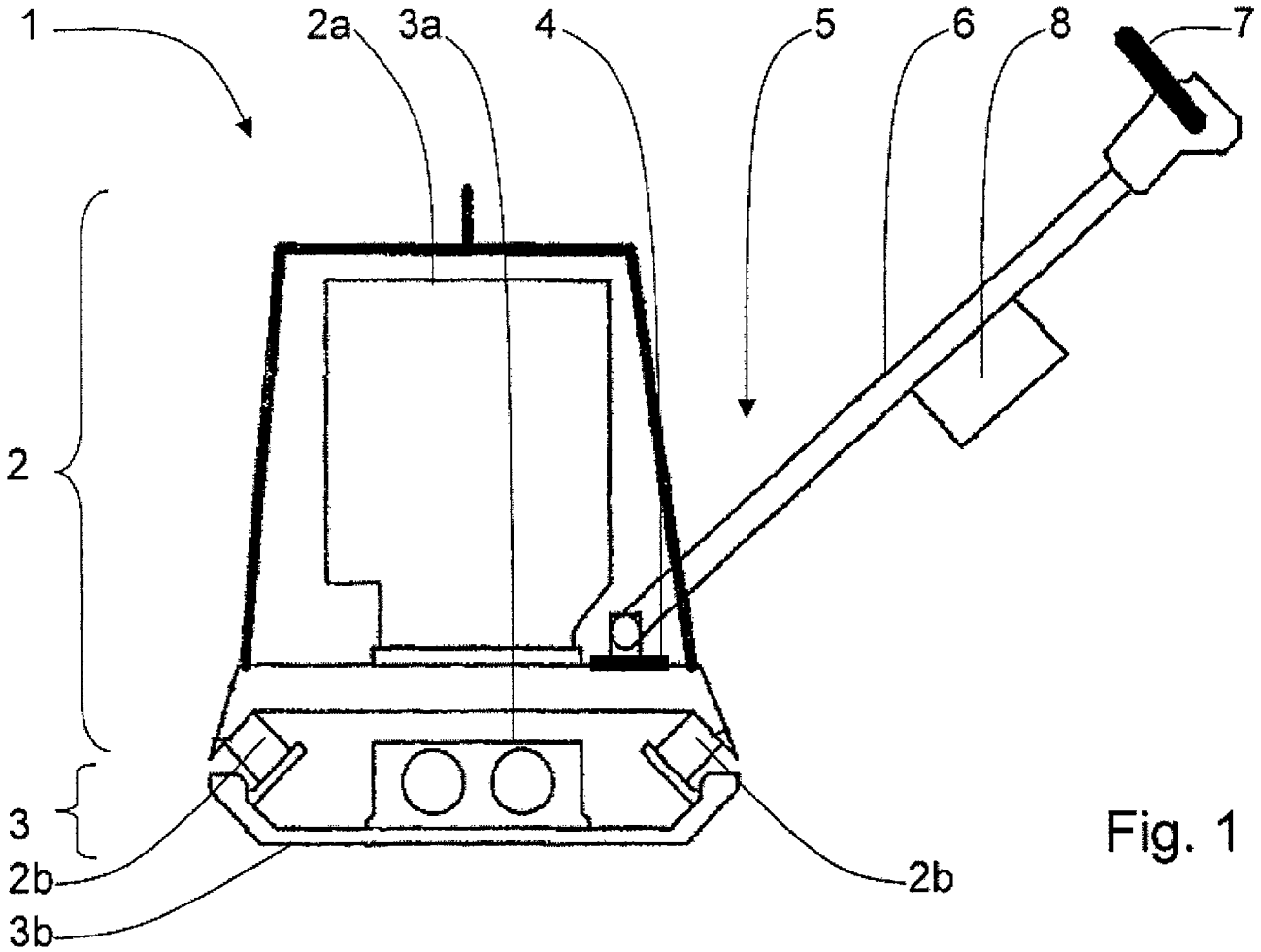
FIG. 1 shows a vibration plate with an energy store arranged on the guide pole.

FIG. 1 schematically shows a lateral sectional view of a vibration plate 1 having an upper mass 2 and a lower mass 3, which can move relative to the upper mass 2 and is coupled to the upper mass 2 by means of rubber buffers 2*b* serving as a spring device, for example. The upper mass 2 has a drive motor 2*a* with an electric motor for driving a compaction device or oscillation excitation apparatus 3*b* arranged on the lower mass 3. By way of example, the oscillation excitation apparatus 3*b* may have at least one unbalanced shaft with an unbalanced mass arranged thereon. Frequently, two counter-rotatable unbalanced shafts having respective unbalanced masses are provided, the phases of which can be adjusted relative to one another in a known manner.

A damping device 4 which serves as an oscillation decoupling device and which may have a rubber buffer and/or a spring device, for example, couples a guide pole 5 to the upper mass 2. The guide pole 5 has a steel pipe 6 on which is provided a guide grip or handle 7 for a user to guide, for example pull or push, the vibration plate 1. The steel pipe 6 of the guide pole 5 has an energy store 8 provided on it for the purpose of supplying electric power to the drive motor 2*a*, particularly the electric motor. As seen in FIG. 1, the energy store 8 is arranged above the compaction device or oscillation apparatus 3*b* and opposite the guide grip or handle 7.

The arrangement of the energy store 8 on the guide pole 5 increases the mass of the guide apparatus 5 overall relative to the upper mass 2 and relative to the lower mass 3. The elastic or damped coupling of the guide pole 5 to the upper mass 2 by the damping device 4 therefore means that the hand-arm vibrations on the guide grip for the user can be significantly reduced. In addition, the vibrations on the energy store 8 arranged on the steel pipe 6 are also reduced, which means that the energy store 8 is also mechanically protected. This mechanical protection of the energy store can be further improved by arranging an additional oscillation decoupling device—not shown—between the steel pipe 6 and the energy store 8 arranged thereon.

The arrangement of the energy store 8 on the steel pipe 6 also allows operating heat from the energy store 8 during charging and/or discharging to be emitted to the steel pipe 6 and dissipated thereby to the ambient air. The steel pipe 6 therefore acts as a heat sink and can replace further optional cooling devices.

The exposed arrangement of the energy store 8 on the guide pole 5 of the vibration plate 1 simplifies access to the energy store 8 for the user. By way of example, the user can easily view a charge state indicator or operating temperature indicator of the energy store 8 and can observe it during operation. In addition, the energy store 8 can be easily removed or detached and placed into a charger, and/or replaced with a further, freshly charged energy store.

Figure 2:
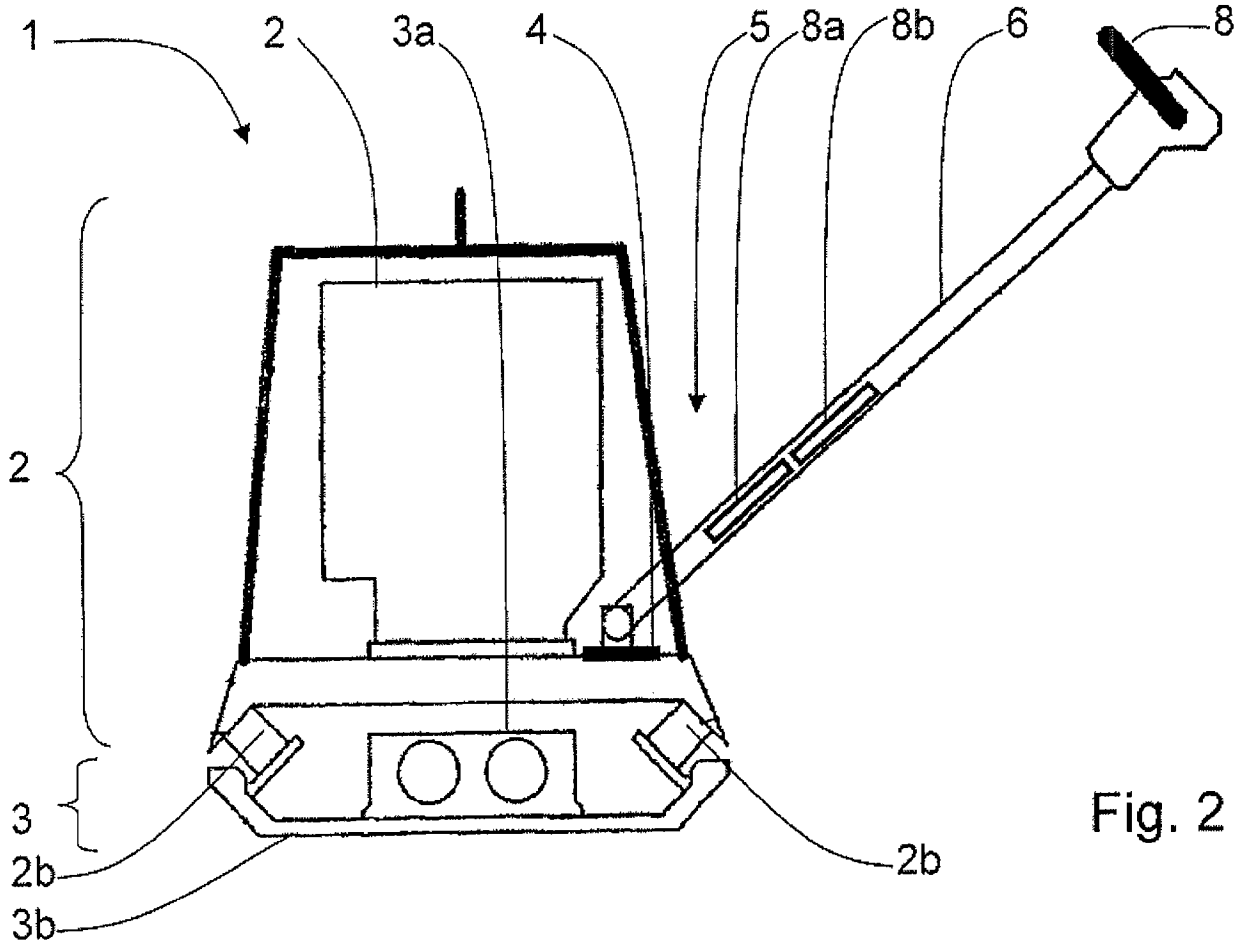
FIG. 2 shows the vibration plate from FIG. 1, but with energy stores inset in the guide pole.

The schematic sectional view of a further vibration plate 1 which is shown in FIG. 2 largely corresponds to that shown in FIG. 1. However, a departure is that instead of the single energy store 8 there are two energy stores 8*a*, 8*b* provided which are inset in the steel pipe 6 in the guide pole 5.

Besides the advantages cited in relation to FIG. 1, this has the further advantages that the energy stores 8*a*, 8*b* are enclosed by the steel pipe 6 such that the latter is thermally coupled to the energy stores 8*a*, 8*b*, and the surface of the energy stores 8*a*, 8*b* with respect to the ambient air is substantially increased. This means that the steel pipe 6 can act as a heat sink for cooling the energy stores 8*a*, 8*b*. Physical adjustments, for example a suitable form—matched to the shape of the energy stores 8*a*, 8*b*—for the cavity in the steel pipe 6 in order to attain suitable thermal coupling between the energy stores 8*a*, 8*b* and the steel pipe 6, and the provision of cooling ribs, can further enhance the effect of the steel pipe 6 as a heat sink.

A further advantage of this arrangement is that the energy stores 8*a*, 8*b* in the steel pipe 6 are mechanically protected against external influences. Thus, dust and dirt cannot get to the energy stores 8*a*, 8*b* or the electrical contact pads thereof directly, and mechanical influences, for example as a result of jolts from the outside, are shielded from the energy stores 8*a*, 8*b* by the steel pipe 6.

In addition, it is advantageous that the insetting of the energy stores 8*a*, 8*b* in the steel pipe 6 ensures effective protection of the user against the thermal and mechanical effects of a possible explosion in a faulty energy store. It is thus possible for the pressure resulting from the explosion to be contained and moderated by the steel pipe. In addition, the steel pipe 6 may have predetermined breaking points, for example indentations or valves, provided on it which channel off the pressure, for example away from the guide grip 7, e.g. in an area surrounding the damping device 4 and hence at an end of the steel pipe 6 which is averted from the guide grip, into the surroundings.

The arrangements shown in FIGS. 1 and 2 for the energy store(s) 8, 8*a*, 8*b* can accordingly also be provided for a tamper for the ground apparatus. By way of example, the energy store(s) 8, 8*a* or 8*b* may be arranged on or in a guide bow for the tamper. The hand-arm vibrations can be favorably influenced thereby and the smooth operation of the tamper can be increased. The aforementioned further advantages apply accordingly.

I claim:

1. An implement for compacting the ground comprising:

an upper mass;

a guide apparatus, coupled to the upper mass, for guiding the implement;

a lower mass which can move relative to the upper mass, which is coupled to the upper mass via a spring device so as to be able to move, and which has a ground contact plate;

an oscillation excitation apparatus for producing relative motion between the upper mass and the lower mass, wherein the guide apparatus can move relative to the upper mass, and an oscillation decoupling device is arranged between the upper mass and the guide apparatus; and a drive for driving the oscillation excitation apparatus; wherein the drive has an electric motor; and the electric motor can be supplied with electric power by an electrical energy store arranged on the guide apparatus.

2. The implement as claimed in claim 1, wherein the guide apparatus has a hollow body in which the energy store can be arranged.

3. The implement as claimed in claim 1, wherein the guide apparatus has a cooling device for cooling the energy store.

4. The implement as claimed in claim 1, wherein the guide apparatus has, in an area surrounding the energy store, a pressure equalization element for channeling off a pressure after a pressure rise, caused by the energy store, in the guide apparatus.

5. The implement as claimed in claim 1, wherein the guide apparatus has a holder for reversibly inserting the energy store.

6. The implement as claimed in claim 1, wherein the guide apparatus and the energy store have a further oscillation decoupling device arranged between them.

7. The implement as claimed in claim 1, wherein the drive has an internal combustion engine in addition to the electric motor, and wherein the oscillation excitation apparatus can be operated either by the internal combustion engine or by the electric motor.

8. The implement as claimed in claim 1, wherein the energy store can be charged via a generator which can be operated by an internal combustion engine.

9. The implement as claimed in claim 1, wherein an electronic control apparatus, coupled to at least one of the energy store, the drive and the oscillation excitation apparatus, is arranged on the guide apparatus.

10. The implement as claimed in claim 1, wherein the implement is a vibration plate or a tamper for compacting the ground.

11. An apparatus for soil compaction, comprising:

an upper mass;

a guide device, coupled to the upper mass, for guiding the implement;

a lower mass which can move relative to the upper mass, which is coupled to the upper mass via a spring device so as to be able to move, and which has a ground contact plate;

an oscillation excitation apparatus for producing relative motion between the upper mass and the lower mass, wherein the guide apparatus can move relative to the upper mass, and an oscillation decoupling device is arranged between the upper mass and the guide apparatus; and a drive for driving the oscillation apparatus; wherein the drive has an electric motor, wherein the electric motor can be supplied with electric power by a rechargeable storage unit, wherein the guide device is vibration-damped, and wherein the storage unit is mounted on the guide device.

12. An apparatus for soil compaction according to claim 11, wherein the guide device has a first end connected to the compaction device and a second end that hears a guide grip or handle.

13. The apparatus for soil compaction according to claim 12, wherein the guide device comprises a guide pole.

14. An apparatus for soil compaction according to claim 13, wherein the storage unit is, in vertical direction, arranged above the compaction device and beneath the second end of the guide pole.

15. An apparatus for soil compaction according to claim 11, wherein the storage unit is arranged in a section of the guide device which is located opposite to a handle section of the guide device.

16. The apparatus for compaction according to claim 11, wherein the storage unit is mounted directly on the guide device below a handle section of the guide device.

* * * * *